US007960035B2

(12) United States Patent
Kozuma et al.

(10) Patent No.: US 7,960,035 B2
(45) Date of Patent: Jun. 14, 2011

(54) HIGH-STRENGTH HOT-ROLLED STEEL SHEET EXCELLENT IN CHEMICAL TREATABILITY

(75) Inventors: Shinji Kozuma, Kakogawa (JP); Masahiro Nomura, Kobe (JP); Ikuro Hashimoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 646 days.

(21) Appl. No.: 11/909,724

(22) PCT Filed: Mar. 30, 2006

(86) PCT No.: PCT/JP2006/306707

§ 371 (c)(1),
(2), (4) Date: Sep. 26, 2007

(87) PCT Pub. No.: WO2006/106847

PCT Pub. Date: Oct. 12, 2006

(65) Prior Publication Data

US 2009/0032148 A1 Feb. 5, 2009

(30) Foreign Application Priority Data

Mar. 30, 2005 (JP) ..... 2005-098828

(51) Int. Cl.

| | |
|---|---|
| ***B32B 3/00*** | (2006.01) |
| ***B32B 5/00*** | (2006.01) |
| ***B32B 15/00*** | (2006.01) |
| ***B32B 15/18*** | (2006.01) |
| ***B32B 15/20*** | (2006.01) |

(52) U.S. Cl. ..... 428/687; 428/220; 428/332; 428/685

(58) Field of Classification Search ..... 428/681, 428/684, 685, 687, 220, 332
See application file for complete search history.

(56) References Cited

U.S. PATENT DOCUMENTS 5,061,321 A 10/1991 Nishimoto et al.
2009/0014095 A1* 1/2009 Mukai et al. ..... 148/320

FOREIGN PATENT DOCUMENTS

EP 1 375 694 * 1/2004
JP 56-130475 10/1981

(Continued)

OTHER PUBLICATIONS

Translation, Shirasawa et al., JP 02-138489, May 1990.*

(Continued)

*Primary Examiner* — Michael La Villa
(74) *Attorney, Agent, or Firm* — Oblon, Spivak, McClelland, Maier & Neustadt, L.L.P.

(57) ABSTRACT

There is provided a high-strength hot rolled steel sheet excellent in phosphatability, wherein a maximum depth (Ry) of pits and bumps, existing on a surface thereof, is not less than 10 μm, and an average interval (Sm) of the pits and the bumps is not more than 30 μm, meeting either a requirement for a load length ratio (tp40) of the pits and the bumps on the surface at not more than 20%, or a requirement for a difference between a load length ratio (tp60) and the load length ratio (tp40), at not less than 60%, or both thereof. The high-strength hot rolled steel sheet is capable of exhibiting stable and excellent phosphatability even if Mo highly effective for reinforcement in strength is added thereto in expectation of a higher strength.

20 Claims, 1 Drawing Sheet

FOREIGN PATENT DOCUMENTS

| | | |
|---|---|---|
| JP | 59-89780 | 5/1984 |
| JP | 2-138489 | 5/1990 |
| JP | 2-138490 | 5/1990 |
| JP | 2-187202 | 7/1990 |
| JP | 5-293503 | 11/1993 |
| JP | 11-350033 | 12/1999 |
| JP | 2000-355775 | 12/2000 |
| JP | 2001-323391 | 11/2001 |
| JP | 2002-226944 | 8/2002 |
| JP | 2004-211178 | 7/2004 |

OTHER PUBLICATIONS

J.Bogi, et al., "Phosphate Conversion Coatings on Steel", Journal of Materials Science, vol. 12, Nov. 30, 1977, pp. 2235-2240.

Philippe Hivart, et al., "Influence of cleaning pretreatments on tribological properties of zinc phosphated steels", Industrial Lubrication and Tribology, vol. 55, No. 2, 2003, pp. 90-96.

* cited by examiner

HIGH-STRENGTH HOT-ROLLED STEEL SHEET EXCELLENT IN CHEMICAL TREATABILITY

TECHNICAL FIELD

The invention relates to a hot rolled steel sheet high in strength, and excellent in phosphatability.

BACKGROUND ART

There has lately been an increasing demand for still higher strength of steel products from the viewpoint of enhancement in fuel economy attendant on reduction in weight of the automobile and so forth, and also from the viewpoint of reduction in exhaust gas, and in particular, with respect to a cold rolled steel sheet, rapid progress toward higher tension (higher strength) has since been made. On the other hand, however, there is not a small demand for high strength and thick steel products for the purpose of enhancement in rigidity from the viewpoint of safety upon collision. With the cold rolled steel sheet, however, it is difficult to cope with such a demand in terms of production facilities, and cost, so that it becomes necessary to cope with such a demand with a hot rolled steel sheet.

Even in the case of making use of the hot rolled steel sheet, press working is required to work the hot rolled steel sheet into a product shape, as with the case of the cold rolled steel sheet, so that ductility such as elongation, and so forth cannot be slighted even though higher strength is aimed at. However, not only the hot rolled steel sheet but also material for steel products, in general, has a natural tendency that the higher the strength, the lower ductility becomes, thereby causing deterioration in workability. Accordingly, with respect to the steel products, addition of an alloying element capable of enhancing strength without causing deterioration in ductility has been under study.

Mo, among others, has attracted attention as an element useful for enhancement in strength without causing much deterioration in ductility. In addition, Mo promotes formation of a bainite structure contributing to an increase in strength by checking formation of a ferrite structure, occurring in a cooling process after completion of hot rolling, and eliminates the need for such process control as to raise a heating temperature of a slab before hot rolling, and to adopt low coiling temperature, so that attention is focused on Mo as an alloying element to be added to produce a high strength hot rolled steel sheet.

Notwithstanding the above, if Mo as the alloying element is added, this will cause deterioration in phosphatability, which leads to poor adhesion of a coating film after electrodeposition coating, thereby causing a problem in that a finished product is adversely affected in respect of external appearance and corrosion resistance, and so forth.

Meanwhile, there have since been proposed several methods for improving a surface condition (for example, microscopic asperity pattern) of an in-process steel sheet in order to enhance the phosphatability of a steel sheet.

For example, Patent Document 1 has disclosed a hot rolled pickled steel sheet with phosphatability enhanced by specifying a microscopic shape of a surface of a steel sheet. This technology is for adjusting a surface condition of the steel sheet by subjecting the steel sheet to skin-pass rolling with the use of a roll (dull roll), provided with an asperity pattern formed on the surface thereof by use of high-energy beams, thereby transferring the asperity pattern on the surface of the roll to the surface of the steel sheet. With this method, however, an increase in cost, due to addition of process steps, such as working of the roll into the dull roll, and the skin-pass rolling, is unavoidable, and furthermore, with respect to a Mo-added steel as an object of the invention, satisfactory effects have not been obtained.

Further, Patent Document 2 has disclosed a method for enhancing phosphatability by controlling an average grain size of a high tensile hot rolled steel sheet with Ti added thereto at not more than 3.0 μm, and controlling surface roughness (Ra) thereof at not more than 1.5 μm. With this method, however, with respect to the Mo-added steel, intended effects have not been obtained either.

Still further, Patent Document 3 has disclosed a technology for controlling a microscopic asperity pattern on the surface of a steel sheet. This technology, however, is intended to improve coating sharpness and press workability through controlling respective diameters of projections in the microscopic asperity pattern to fall in a range of from 50 to 200 μm, which is by far larger than several micrometers representing a grain size of zinc phosphate on which the present invention focuses attention as a determinant affecting the phosphatability. Hence, the technology hardly contributes to enhancement in the phosphatability

[Patent Document 1] JP-A No. 187202/1990
[Patent Document 2] JP-A No. 226944/2002
[Patent Document 3] JP-A No. 293503/1993

DISCLOSURE OF THE INVENTION

The invention has been developed with attention focused on circumstances described as above, and it is an object of the invention to provide a hot rolled steel sheet capable of exhibiting stable and excellent phosphatability, said hot rolled steel sheet including not only a hot rolled steel sheet without Mo contained therein, but also a hot rolled steel sheet with Mo added thereto, in expectation of a higher strength.

A hot rolled steel sheet according to the invention, having succeeded in solving the problems described in the foregoing, is a hot rolled steel sheet not only satisfying requirements such as a maximum depth (Ry) of pits and bumps, existing on a surface thereof, being not less than 10 μm, and an average interval (Sm) of the pits and the bumps, being not more than 30 μm, but also satisfying either one of the following two requirements under 1) and 2), or more preferably concurrently satisfying both the two requirements under 1) and 2):

1) a load length ratio (tp40) of the pits and the bumps on the surface is not more than 20%; and
2) a difference between a load length ratio (tp60) of the pits and the bumps on the surface, and the load length ratio (tp40) is not less than 60%.

The hot rolled steel sheet according to the invention can be suitably changed in chemical composition according to a strength as required, preferably containing C ranging from 0.03 to 1.0% (mass % as a chemical component, the same is applicable hereinafter), Si not more than 2.0%, Mn ranging from 0.3 to 4.0%, and Al ranging from 0.001 to 0.5%. Further, for the purpose of reinforcement in strength, the hot rolled steel sheet preferably contains Mo ranging from 0.05 to 1.0%, or at least one element selected from the group consisting of:

Cr not more than 1.5% (excluding 0%);
Ti not more than 0.2% (excluding 0%);
Nb not more than 0.1% (excluding 0%);
V not more than 0.1% (excluding 0%);
Cu not more than 1.0% (excluding 0%);
Ni not more than 1.0% (excluding 0%);
B not more than 0.002% (excluding 0%); and
Ca not more than 0.005% (excluding 0%), as necessary.

As a strength level of the hot rolled steel sheet according to the invention varies depending on applications, and purposes, the strength level cannot be indiscriminately determined, however, the strength level for general purpose use is not lower than 390 MPa in tensile strength. In order to meet a recent demand for higher strength of a steel sheet, the steel sheet preferably has a tensile strength not lower than a 780-MPa level, in which case, the hot rolled steel sheet preferably contains Mo in the range of 0.05 to 1.0%, and Cr not more than 1.5%. Further, in order to obtain a hot rolled steel sheet having a tensile strength not lower than a 900-MPa level, the hot rolled steel sheet preferably contains Mo ranging from 0.05 to 1.0%, and Cr ranging from 0.3 to 1.5%, bainite preferably occupying not less than 85% of a metal structure.

EFFECT OF THE INVENTION

With the invention, by specifying the maximum depth (Ry) of the pits and the bumps on the surface of the hot rolled steel sheet, and the average interval (Sm) of the pits and the bumps, and by determining the load length ratio (tp40) of the pits and the bumps on the surface, and/or the difference between the load length ratio (tp60) and the load length ratio (tp40), it is possible to considerably improve phosphatability, and to ensure excellent phosphatability with respect to not only a hot rolled steel sheet without Mo contained therein, but also even a hot rolled steel sheet containing Mo causing deterioration in phosphatability, in a suitable amount, for reinforcement of strength, thereby providing a hot rolled steel sheet having excellent phosphatability in combination with high strength.

BEST MODE FOR CARRYING OUT THE INVENTION

Under the circumstances described in the foregoing, the inventor, et al. have since conducted energetic studies in order to overcome a problem of deterioration in phosphatability, due to addition of Mo, with respect to a hot rolled steel sheet with Mo added thereto as a means for increasing strength.

Figure 1:
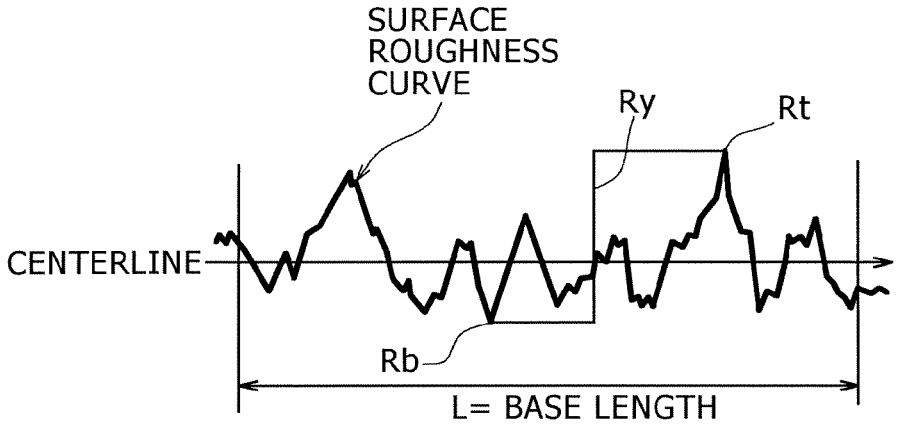
FIG. 1 is a schematic diagram for describing the definition of a maximum depth (Ry) of pits and bumps, existing on a surface of a steel sheet.
Figure 2:
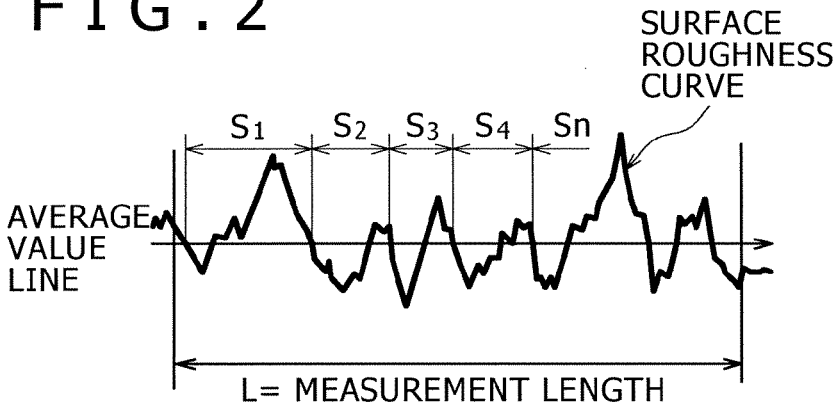
FIG. 2 is a schematic diagram for describing the definition of an average interval (Sm) of the pits and the bumps, existing on the surface of the steel sheet.
Figure 3:
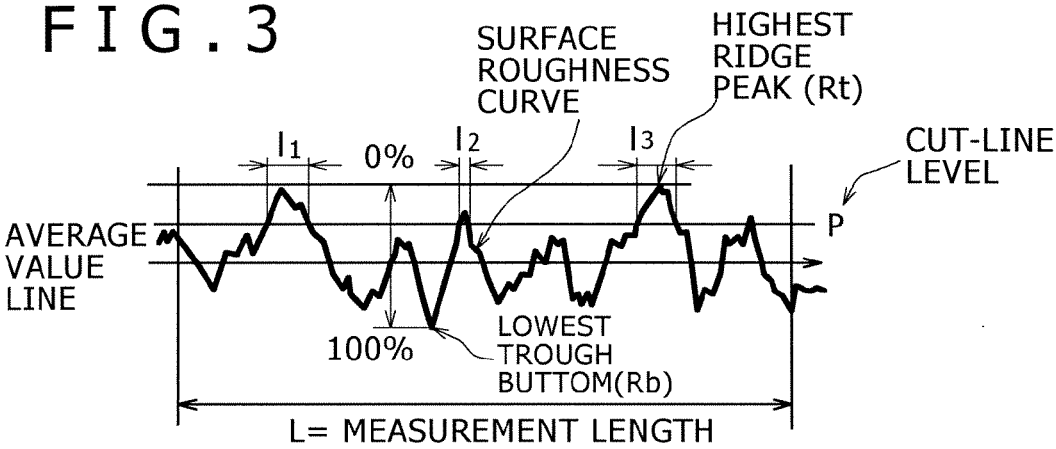
FIG. 3 is a schematic diagram for describing the definition of load length ratios (tp40), (tp60) of the pits and the bumps, existing on the surface of the steel sheet.

As a result, it has been found out that if a maximum depth (Ry) of pits and bumps on a surface of a hot rolled steel sheet is specified "not less than 10 μm", and an average interval (Sm) of the pits and the bumps is specified "not more than 30 μm", and a load length ratio (tp40) of the pits and the bumps on the surface is controlled to not more than 20%, and/or a difference {(tp60)−(tp40)} between a load length ratio (tp60) of the pits and the bumps on the surface, and the load length ratio (tp40) is controlled to not less than 60%, it is possible to check deterioration in phosphatability as much as possible, and to secure tensile strength at a high level, with respect to not only a hot rolled steel sheet without Mo contained therein, but also even a hot rolled steel sheet containing Mo in a suitable amount, so that a hot rolled steel sheet having excellent phosphatability in combination with high strength can be provided The maximum depth (Ry) of the pits and the bumps on the surface, as specified in the invention, refers to a clearance between the highest ridge peak (Rt) of a surface roughness curve and the lowest trough bottom (Rb) thereof, as shown in, for example, FIG. 1, and assuming that a point of the surface roughness curve, intersecting an average value line, where there occurs shifting of a ridge part of the curve to a trough part thereof, is defined as a change point, as shown in, for example, FIG. 2, the average interval (Sm) of the pits and the bumps refers to an average value of intervals ($S_1$, $S_2$, . . . , $S_n$) between the respective change points, and the change points subsequent thereto, respectively. Further, the load length ratio (tp) refers to respective percentages of cut portion lengths ($L_1$, $L_2$, . . . , $L_n$) obtained when the surface roughness curve is cut at a cut-line level (p), as shown in, for example, FIG. 3, to a measurement length (L), the load length ratio being expressed as 0 (tp0) if the cut-line level (p) is at the highest ridge peak (Rt) while the same being expressed as 100 (tp100) if the cut-line level (p) is at the lowest trough bottom (Rb). And, the percentage of the cut portion lengths ($L_1+L_2+L_3+ \ldots , L_n$) when the cut-line level (p) is at "40" or "60" is a value that is expressed as (tp40) or (tp60).

It has since been confirmed that not only a hot rolled steel sheet without Mo contained therein, needless to say, but also even a hot rolled steel sheet containing Mo in suitable content can exhibit stable and excellent phosphatability provided that the maximum depth (Ry) of the pits and the bumps on the surface is not less than 10 μm, the average interval (Sm) is not more than 30 μm, the load length ratio (tp40) of the pits and the bumps on the surface is not more than 20%, and/or the difference {(tp60)−(tp40)} between the load length ratio (tp60), and the load length ratio (tp40) is not less than 60%.

With the invention, it is deemed that the relatively deeper the maximum depth (Ry) of the pits and the bumps on the surface, and the relatively smaller the average interval (Sm) of the pits and the bumps, as described above, the finer and deeper will be the pits and the bumps on the surface, so that there will be enhancement in function of the pits and the bumps, serving as sites for nucleation of zinc phosphate crystals, and the surface in its entirety will become prone to formation and growth of zinc phosphate crystals, thereby enhancing phosphatability.

Further, it is deemed that the load length ratio (tp40) of the pits and the bumps on the surface at "not more than 20%" (that is, relatively small) means that there are relatively more regions (areas) of the pits as recessed than those of the bumps protruding from the surface, and the pits each become the site for nucleation of zinc phosphate crystals, thereby furthering formation and growth of zinc phosphate crystals, while the difference {(tp60)−(tp40)} between the load length ratio (tp60), and the load length ratio (tp40) at not less than 60% (that is, the difference between tp60 and tp40 is relatively large) means that a slope spreading from the peak of each of the bumps to the bottom of each of the pits does not have a straight face inclined toward the bottom of each of the pits, but has a curviform recessed face, and a portion of the slope, having the curviform recessed face, functions as the site for nucleation of zinc phosphate crystals, thereby furthering formation and growth of zinc phosphate crystals, and contributing to further enhancement in phosphatability.

As is evident from working examples described later in the present specification, with the invention, it has become possible at any rate to obtain the stable and excellent phosphatability by specifying the load length ratio (tp40), and/or the difference {(tp60)−(tp40)} between the load length ratio (tp60), and the load length ratio (tp40), which have never been recognized in the past from the viewpoint of the phosphatability, at "not more than 20%", and "not less than 60%", respectively, besides setting the maximum depth (Ry) of the pits and the bumps on the surface to "not less than 10 μm", and the average interval (Sm) to "not more than 30 μm".

The average interval (Sm) at not more than 20 μm, the load length ratio (tp40) at not more than 15%, and the difference in the load length ratio {(tp60)−(tp40)} at not less than 70% are more preferable from the viewpoint of enhancing the phosphatability. Any particular value is not specified for the load length ratio (tp60), but a preferable value for tp60 from the viewpoint of enhancing the phosphatability is not less than 60%, and is more preferably not less than 70%.

With a surface condition of a steel sheet, kept as above, phosphate crystals precipitated on the surface of the steel sheet, due to phosphate treatment, becomes more microscopic, and further, a P ratio as an index of soundness of a phosphate crystal, that is, a ratio of phosphophyllite (P) to hopeite (H) {P/(P+H)} comes closer to 1, so that the phosphatability is enhanced. Further, in the case of steel with Mo added thereto, since a natural potential thereof shifts in a more noble direction within a phosphate treatment liquid, the phosphatability undergo deterioration, however, if the surface condition is kept as described in the foregoing, it is possible to obtain excellent phosphatability more than enough to make up for degradation in the phosphatability, caused by addition of Mo.

There is no particular restriction imposed on a method for obtaining the surface condition described, however, the inventor, et al. have confirmed based on the results of experiments that it is possible to cause a surface condition to come close to the surface condition described by strictly controlling pickling time. More specifically, pickling for removal of oxides (the so-called mill scale) formed on the surface of a steel sheet during a hot rolling process step is conducted at temperature ranging from about 50 to about 85° C. for about 10 to 30 seconds by use of an aqueous solution of hydrochloric acid normally on the order of 10 to 20% in concentration, however, the surface condition that the invention aims at can be attained by setting concentration of hydrochloric acid in a pickling solution to a little higher side, and by setting pickling temperature to a little higher side, and pickling time a little longer. More specifically, assuming that the concentration of hydrochloric acid in the pickling solution is A (%), the pickling temperature is B (° C.), and the pickling time (immersion time) C (sec), it has been confirmed that the surface condition described in the foregoing can be obtained with greater ease if those variables are controlled so as to satisfy a relationship represented by the following formula (1) (for example, 11% HCl-75° C.-80 sec, 15% HCl-80° C.-50 sec, 16% HCl-85° C.-40 sec, and so forth), and more preferably if the pickling solution is fed onto the surface of a steel sheet traveling in a pickling bath, at a flow rate on the order of 1.0 to 5.0 m/sec, or the pickling solution is blown in through a nozzle, thereby causing the pickling solution to be in a state of high speed turbulent flow on the surface of the steel sheet.

[formula (1)]

$$(A/100)\times B^2\times C\geqq 40000 \quad (1)$$

Now, a preferable chemical composition of a steel product for use in carrying out the invention is determined for the following reason.

C: 0.03 to 1.0%

C is an essential element for enhancement in strength of a hot rolled steel sheet, and if C is at less than 0.03%, most of C is dissolved into ferrite in solid solution state, so that formation of carbides (basically cementite as iron carbide, including carbides of Nb, Ti, V, and so forth, where appropriate) contributing to an increase in strength is insufficient and strength at a level which the invention intends to achieve cannot be obtained. C at not less than 0.5% is more preferably contained. However, if C content is excessive, this will cause adverse effects to appear on weldability besides causing deterioration in formability, so that C is preferably controlled at not more than 1.0% at most, more preferably at not more than 0.23%.

Si: no more than 2% (including 0%)

Si is an element contributing to an increase in strength of a steel product besides effectively acting as an deoxidizing element when molten steel is produced, however, excessively high Si content causes not only degradation in formability, but also surface effects to be prone to occur to thereby adversely affect even pickling and coating characteristics, so that Si is preferably controlled at not more than 2.0% at most, more preferably at not more than 1.5%.

Mn: 0.3 to 4.0%

Mn is an element important in locking S unavoidably mixed into steel, and acting as a factor in embrittlement, in the form of MnS, besides being an element effective in securing strength. In order to cause those actions to be effectively exhibited, at least not less than 0.3% of Mn is preferably contained, and not less than 0.5% of Mn is more preferably contained. However, if Mn content is excessively high, this will cause not only deterioration in ductility to thereby adversely affect workability, but also deterioration in weldability, so that Mn is preferably controlled at not more than 4.0% at most, more preferably at not more than 2.5%.

Al: 0.005 to 0.5%

Al is an important element as a deoxidizing element. In order to cause an effect thereof to be effectively exhibited, not less than 0.001% of Al must be contained, and not less than 0.005% of Al is preferably contained. However, if Al content is excessively high, this will not only cause deterioration in toughness, due to an increase in oxide inclusion amounts, but also cause surface defects to be prone to occur. Accordingly, Al is preferably controlled at not more than 0.5%, more preferably at not more than 0.3%.

Mo: not more than 1.0%

Mo is an important element in promoting higher strength of a hot rolled steel sheet, due to reinforcement in solid solubility, and if not less than 0.05% of Mo is contained, an effect thereof can be effectively exhibited. However, if a required strength is below a 390 MPa level, there will be no need for taking the trouble of causing Mo to be contained. Mo content is dependent on a strength level of a hot rolled steel sheet, as required, but for the effect of Mo to be exhibited with more reliability, the Mo content need be not less than 0.1%. However, if the Mo content exceeds 0.1%, this will cause considerable degradation in ductility (workability) more than contribution to higher strength, made by Mo, and abrupt aggravation in a balance between strength and elongation, so that the upper limit is determined at 0.1%. The Mo content is more preferably controlled at not more than 0.5%. Further, the invention has a main feature in that the degradation in the phosphatability, caused by addition of Mo, is made up for by improvement in the surface condition, as previously described, but an effect of improvement in the phosphatability, due to the surface condition, can be effectively exhibited with respect to a hot rolled steel sheet without Mo contained therein, as well.

Cr: not more than 1.5%

Cr added in a small amount has a function of enhancing strength of a hot rolled steel sheet, and particularly, in the case where a tensile strength not lower than a 780-MPa level is required, at least not less than about 0.1% of Cr is preferably contained while in the case where a tensile strength not lower than a 900-MPa level is required, not less than about 0.3% of Cr is preferably contained. However, if Cr content is excessively high, this will cause considerable degradation in ductility (workability) more than contribution to higher strength, made by Cr, as is the case with Mo, so that Cr is preferably controlled at not more than 1.5% at most, more preferably at not more than 1.0%.

Further, if a required tensile strength ranges from 390 to 780-MPa level, a target tensile strength can be obtained without addition of Cr by simply adjusting respective contents of C, Si, Mn, and Mo among those elements described as above. However, even in the case of producing a hot rolled steel sheet at such a strength level, strength can be easily controlled simply by finely adjusting an addition amount of Cr, so that addition of Cr is quite effective from a standpoint of practicality. On the basis such a point of view, more preferable Cr content is not less than 0.1%, and not more than 1.5%.

Essential constituent elements of steel for use in carrying out the invention are as above-described, the balance being "substantially" Fe. Herein, "substantially" means that unavoidable impurity elements that can be mixed into raw material for steel, or into steel during a production process thereof may be contained, or additional other elements in small amounts, respectively, may be contained within such ranges as not to interfere with effects of the functions of the respective constituent elements described in the foregoing. The unavoidable impurity elements include, for example, P, S, N, O, and so forth, and the other elements include Ti, Nb, V, Cu, Ni, B, Ca, and so forth by way of example. However, if these elements each are excessively high in content, this will cause more or less deterioration in ductility, and adverse effects on the phosphatability, so that Ti should be controlled at not more than 0.2%, Nb at not more than 0.1%, V at not more than 0.1%, Cu at not more than 1.0%, Ni at not more than 1.0%, B at not more than 0.002%, and Ca at not more than 0.005%, respectively.

Further, a hot rolled steel sheet according to the invention can be provided with an optional strength, that is, not lower than 390-MPa level, not lower than 780-MPa level, and not lower than 900-MPa level by varying respective contents of C, Si, Mn, Mo, Cr, and so forth, according to applications, however, when it is desired to obtain a high strength hot rolled steel sheet with strength not lower than 900-MPa level, a steel structure is preferably rendered bainite-rich (preferably not less than 85% of the steel structure) by a process whereby Cr as well is essentially used as a strength-reinforcing element other than Mo, and an elaborate heat treatment condition is devised (for example, for a hot rolling finishing temperature, not lower than the $Ac_3$ point is adopted, for a cooling rate thereafter, not less than 30° C./sec is adopted, a finished product is coiled in a temperature range of 350 to 550° C., and so forth).

With the invention having a makeup described as above, it has become possible to improve the phosphatability with respect to a high strength steel sheet, as a target, and in particular, even in the case of a high strength hot rolled steel sheet to which MO useful as the strength-reinforcing element is added, it is possible to prevent the degradation in the phosphatability, pointed out as a practical problem attendant on addition of Mo, by adequately controlling the surface condition, and to provide a high strength hot rolled steel sheet having a high strength in combination with excellent phosphatability.

EMBODIMENTS

The invention will be more specifically described hereinafter with reference to working examples, however, it is to be pointed out that the invention is obviously not limited to the working examples cited hereunder, and that various changes and modifications may be naturally made in the invention without departing form the spirit and scope thereof.

Steel types Nos. 1 to 15, having chemical compositions shown in Table 1, respectively, were melted to be cast into respective slabs. Those slabs were reheated to the $Ac_3$ point or higher to be thereby hot rolled under conditions shown in Table 2, respectively, whereupon hot rolled steel sheets, each 3.2 mm thick, were obtained. In Table 2, there are also shown mechanical properties of the respective hot rolled steel sheets, and area ratios of bainite, in the longitudinal sectional structures thereof.

The respective hot rolled steel sheets thus obtained were pickled under conditions shown in Tables 3, 4, respectively, and the surface conditions of respective pickled steel sheets thus obtained were observed with a laser microscope (model No. "1LM21W" manufactured by Laserteck Corp.) using an 50× objective lens to thereby find respective values of an average interval (Sm) of pits and bumps on the surfaces of the respective pickled steel sheets, a maximum depth (Ry), load length ratios (tp40), (tp60), and a difference between (tp60)−(tp40). In measurement of those values, randomly select 10 spots (an area of 0.16×0.22 mm per one spot) were scanned, and an average value of values found at the 10 spots, respectively, is taken as a measured value. In addition, the phosphatability were evaluated with the following method. Further, parts of specimens were subjected to pickling, and subsequently, a skin pass operation was applied thereto before evaluation on the phosphatability. Results en bloc are shown in Tables 3, 4, respectively.

Phosphatability:

After subjecting the surfaces of the respective specimen steel sheets to phosphate treatment under the following condition, the surfaces of the respective steel sheets were observed with 1000× SEM, and subsequently, an adhesion state of zinc phosphate was examined with respect to randomly select 10 visual fields, thereby evaluating the phosphatability on the basis of the following criteria.

Phosphate Treatment Liquid:

use of a treatment liquid "Palbond L3020" manufactured by Nihon Parkerizing Co., Ltd.

Phosphate Treatment Process:

degreasing (at 45° C. for 120 sec, with the use of a degreaser "Finecleaner" manufactured by Nihon Parkerizing Co., Ltd.)→rinsing in water (30 sec)→surface adjustment (immersed in a surface adjustment liquid "Preparen Z" manufactured by Nihon Parkerizing Co., Ltd., for 15 sec) →phosphate treatment (immersed in the surface adjustment liquid at 43° C. for 120 sec)

Evaluation Criteria

Un-Precipitated Parts of Zinc Phosphate Crystal:

⊙: Un-precipitated parts of zinc phosphate crystal did not exist in all the 10 visual fields, and the zinc phosphate crystals were found evenly deposited thereon.

○: In the 3 visual fields out of the 10 visual fields, an area covering the un-precipitated parts of the zinc phosphate crystals represented not more than 5% of the whole area.

X: a state other than the above-described

Grain Size

Evaluation was made on an average grain size of 10 pieces of larger crystal grains, selected in the respective visual fields.

X: not less than 10 μm,

○: from not less than 7 μm to less than 10 μm,

⊙: from not less than 4 μm to less than 7 μm,

·: less than 4 μm

P−ratio

Peaks corresponding to phosphophyllite (P) and hopeite (H), respectively, were measured by X-ray diffraction with respect to the surfaces of the respective steel sheets, subjected to the phosphate treatment, and evaluation was made on the basis of the P ratio {P/(P+H)} (an average value where n=5).

X: less than 0.85 in the P ratio={P/(P+H)}

○: from not less than 0.85 to less than 0.93 in the P ratio={P/(P+H)}

⊙: not less than 0.93 to less than 0.96 in the P ratio={P/(P+H)}

·: not less than 0.96 in the P ratio={P/(P+H)}

Determination

On the basis of the Un-precipitated parts of zinc phosphate crystal, grain size, and P ratio, described as above, overall evaluation was made as follows.

Overall Evaluation

· (the best): if the Un-precipitated parts of zinc phosphate crystal was ⊙ or better, the grain size was ·, and the P−ratio was ·.

⊙ (excellent): if the Un-precipitated parts of zinc phosphate crystal, grain size, and P−ratio were all ⊙ or better, excluding the above.

○ (acceptable): if the Un-precipitated parts of zinc phosphate crystal, grain size, and P−ratio were all ○ or better, excluding the above.

X (poor): if any one of the Un-precipitated parts of zinc phosphate crystal, grain size, and P−ratio was found as X

TABLE 1

| Steel type No. | C | Si | Mn | P | S | Al | Cr | Mo | Ti | Nb | V | Cu | N | B | Ca | N | O | $Ac_3$ point |
|---|---|---|---|---|---|---|---|---|---|---|---|---|---|---|---|---|---|---|
| 1 | 0.06 | 0.03 | 1.07 | 0.017 | 0.002 | 0.045 | 0.01 | 0.05 | — | — | — | — | — | — | — | 43 | 13 | 861 |
| 2 | 0.10 | 1.21 | 1.49 | 0.010 | 0.001 | 0.033 | 0.02 | 0.11 | — | — | — | — | — | — | — | 29 | 33 | 878 |
| 3 | 0.09 | 1.13 | 1.89 | 0.014 | 0.002 | 0.052 | 0.53 | 0.29 | — | — | — | — | — | — | — | 35 | 21 | 875 |
| 4 | 0.11 | 1.11 | 1.92 | 0.015 | 0.002 | 0.038 | 0.21 | 0.51 | — | — | — | — | — | — | — | 39 | 31 | 874 |
| 5 | 0.03 | 0.23 | 1.71 | 0.018 | 0.006 | 0.032 | — | — | — | — | — | — | — | — | — | 29 | 37 | 859 |
| 6 | 0.05 | 0.91 | 1.27 | 0.018 | 0.005 | 0.035 | — | — | — | — | — | 0.03 | — | — | — | 33 | 29 | 893 |
| 7 | 0.09 | 1.89 | 1.77 | 0.016 | 0.004 | 0.041 | — | 0.04 | — | — | — | — | 0.03 | — | — | 29 | 33 | 909 |
| 8 | 0.10 | 1.11 | 1.53 | 0.020 | 0.004 | 0.039 | — | 0.06 | 0.010 | — | — | — | — | — | 10 | 38 | 23 | 885 |
| 9 | 0.09 | 1.24 | 1.51 | 0.015 | 0.005 | 0.042 | — | 0.09 | — | 0.010 | 0.015 | — | — | 4 | — | 32 | 32 | 891 |
| 10 | 0.11 | 1.18 | 1.49 | 0.013 | 0.007 | 0.052 | — | — | — | — | — | — | — | 8 | — | 39 | 28 | 880 |
| 11 | 0.09 | 1.09 | 1.73 | 0.018 | 0.004 | 0.038 | — | — | — | — | — | 0.20 | 0.15 | — | — | 40 | 20 | 867 |
| 12 | 0.15 | 0.03 | 1.18 | 0.020 | 0.007 | 0.023 | — | 0.08 | — | — | — | — | — | — | — | 33 | 19 | 823 |
| 13 | 0.09 | 1.12 | 1.89 | 0.017 | 0.007 | 0.048 | 0.11 | 0.12 | — | — | 0.010 | — | — | — | 15 | 29 | 16 | 876 |
| 14 | 0.05 | 0.50 | 1.27 | 0.018 | 0.005 | 0.035 | — | 1.01 | — | — | — | — | — | — | — | 21 | 25 | 908 |
| 15 | 0.05 | 0.50 | 1.27 | 0.018 | 0.005 | 0.035 | — | 0.81 | — | — | — | — | — | — | — | 21 | 25 | 901 |

TABLE 2

| Production method | Steel type No. | $Ac_3$ point | Production condition: Finishing temperature (° C.) | Production condition: Cooling rate (° C./s) | Production condition: Take-up temperature (° C.) | Mechanical properties: Yield strength (MPa) | Mechanical properties: Tensile strength (MPa) | Mechanical properties: Elongation (%) | Structure (SEM observation) (area %): F | Structure (SEM observation) (area %): B |
|---|---|---|---|---|---|---|---|---|---|---|
| 1 | 1 | 861 | 893 | 39 | 550 | 321 | 430 | 38 | 82 | 18 |
| 2 | 2 | 878 | 890 | 44 | 421 | 537 | 806 | 19 | 35 | 65 |
| 3 | 3 | 875 | 911 | 49 | 512 | 742 | 921 | 14 | 15 | 85 |
| 4 | 4 | 874 | 900 | 42 | 492 | 855 | 1021 | 13 | 6 | 94 |
| 5 | 5 | 859 | 899 | 51 | 475 | 338 | 451 | 32 | 70 | 30 |
| 6 | 6 | 893 | 900 | 57 | 502 | 502 | 598 | 28 | 65 | 35 |
| 7 | 7 | 909 | 910 | 52 | 521 | 690 | 796 | 19 | 31 | 69 |
| 8 | 8 | 885 | 901 | 48 | 530 | 584 | 847 | 17 | 32 | 68 |
| 9 | 9 | 891 | 911 | 49 | 512 | 576 | 843 | 18 | 36 | 64 |
| 10 | 10 | 880 | 899 | 51 | 498 | 541 | 821 | 19 | 38 | 62 |
| 11 | 11 | 867 | 891 | 49 | 499 | 568 | 888 | 18 | 37 | 63 |
| 12 | 12 | 823 | 893 | 49 | 602 | 600 | 690 | 25 | 52 | 48 |
| 13 | 13 | 876 | 883 | 48 | 512 | 375 | 523 | 29 | 75 | 25 |
| 14 | 14 | 908 | 910 | 55 | 650 | 776 | 849 | 12 | 13 | 87 |
| 15 | 15 | 901 | 910 | 55 | 550 | 654 | 736 | 20 | 37 | 63 |

* As an appropriate formula for Ar3 was not available, a finishing temperature was determined on the following concept in this case to thereby execute an operation.
Ac3 is worked out on the following formula, and a finishing temperature is not lower than Ac3 on the premise that Ar3 never exceeds Ac3

TABLE 3

| No. | Production method | Steel type No. | Pickling condition: Hydrochloric acid concentration (%) | Pickling condition: Hydrochloric acid temperature (° C.) | Pickling condition: Immersion time (s) | Pickling condition: Flow rate (m/s) | Skin pass Draft (%) | Load length ratio: tp40 (%) | Load length ratio: tp60 (%) | Load length ratio: tp60 − tp40 |
|---|---|---|---|---|---|---|---|---|---|---|
| 1 | 1 | 1 | 15 | 80 | 20 | 0.5 | | 31.70 | 90.6 | 58.9 |
| 2 | 1 | 1 | 15 | 80 | 55 | 3.3 | | 26.6 | 88.0 | 61.4 |
| 3 | 1 | 1 | 15 | 80 | 60 | 3.3 | | 13.7 | 81.2 | 67.5 |
| 4 | 1 | 1 | 15 | 80 | 80 | 3.3 | | 15.3 | 73.3 | 58.0 |
| 5 | 2 | 2 | 15 | 80 | 20 | 0.5 | | 25.0 | 81.4 | 56.4 |
| 6 | 2 | 2 | 15 | 80 | 55 | 3.5 | | 24.9 | 87.0 | 62.1 |
| 7 | 2 | 2 | 15 | 80 | 60 | 4.0 | | 19.3 | 83.3 | 64.0 |
| 8 | 2 | 2 | 15 | 80 | 80 | 3.5 | | 19.9 | 71.3 | 51.5 |
| 9 | 3 | 3 | 15 | 80 | 20 | 0.5 | | 32.9 | 86.7 | 53.8 |
| 10 | 3 | 3 | 15 | 80 | 55 | 3.0 | | 24.7 | 95.7 | 71.0 |
| 11 | 3 | 3 | 15 | 80 | 60 | 3.2 | | 11.7 | 84.8 | 73.1 |
| 12 | 3 | 3 | 15 | 80 | 80 | 3.0 | | 2.3 | 60.2 | 57.9 |
| 13 | 3 | 3 | 15 | 80 | 60 | 3.1 | 1.0 | 34.8 | 90.1 | 55.3 |
| 14 | 4 | 4 | 15 | 80 | 20 | 1.2 | | 29.2 | 81.3 | 52.1 |
| 15 | 4 | 4 | 15 | 80 | 60 | 3.1 | | 12.2 | 83.4 | 71.2 |

| No. | Average interval of surface pits and bumps Sm (μm) | Max. depth Ry (μm) | Phosphatability: Un-precipitated parts of zinc phosphate crystal (%) | Phosphatability: Grain size (μm) | Phosphatability: P ratio P/P + H | Phosphatability: Determination |
|---|---|---|---|---|---|---|
| 1 | 14.3 | 11.5 | X | X | ○ | X |
| 2 | 13.3 | 12.1 | ○ | ○ | ◎ | ○ |
| 3 | 12.1 | 16.1 | ◎ | ◎ | ● | ◎ |
| 4 | 13.3 | 16.7 | ○ | ○ | ○ | ○ |
| 5 | 17.7 | 17.3 | X | X | ○ | X |
| 6 | 15.0 | 22.1 | ○ | ○ | ○ | ○ |
| 7 | 16.1 | 22.5 | ◎ | ◎ | ◎ | ◎ |
| 8 | 18.9 | 23.4 | ○ | ○ | ◎ | ○ |
| 9 | 17.2 | 17.9 | X | X | ○ | X |
| 10 | 15.4 | 21.1 | ○ | ○ | ◎ | ○ |
| 11 | 14.8 | 22.2 | ◎ | ◎ | ◎ | ◎ |
| 12 | 18.4 | 21.9 | ○ | ○ | ○ | ○ |
| 13 | 15.4 | 17.4 | X | ○ | ○ | X |
| 14 | 17.5 | 15.9 | X | X | X | X |
| 15 | 13.9 | 21.3 | ◎ | ◎ | ◎ | ◎ |

TABLE 4

| No. | Production method | Steel type No. | Pickling condition: Hydrochloric acid concentration (%) | Pickling condition: Hydrochloric acid temperature (° C.) | Pickling condition: Immersion time (s) | Pickling condition: Flow rate (m/s) | Skin pass Draft (%) | Load length ratio: tp40 (%) | Load length ratio: tp60 (%) | Load length ratio: tp60 − tp40 |
|---|---|---|---|---|---|---|---|---|---|---|
| 16 | | | 13 | 85 | 30 | 0.5 | | 42.9 | 93.3 | 50.4 |
| 17 | | | 13 | 85 | 45 | 4.1 | | 31.6 | 92.2 | 60.6 |
| 18 | | | 13 | 83 | 65 | 4.0 | | 2.3 | 67.5 | 65.2 |
| 19 | | | 13 | 85 | 85 | 3.0 | | 1.2 | 53.3 | 52.1 |
| 20 | | | 16 | 71 | 50 | 0.4 | | 43.0 | 94.5 | 51.5 |
| 21 | | | 16 | 71 | 50 | 3.9 | | 33.0 | 95.3 | 62.3 |
| 22 | | | 16 | 85 | 50 | 3.9 | | 19.3 | 93.2 | 73.9 |
| 23 | | | 16 | 85 | 70 | 4.1 | | 3.2 | 62.9 | 59.7 |
| 24 | | | 16 | 85 | 70 | 3.9 | 1.5 | 39.7 | 99.8 | 60.1 |
| 25 | | | 11 | 75 | 80 | 3.5 | | 27.9 | 90.1 | 62.2 |
| 26 | | | 11 | 75 | 90 | 3.5 | | 17.9 | 78.3 | 60.4 |
| 27 | | | 11 | 75 | 125 | 3.5 | | 2.5 | 61.4 | 58.9 |
| 28 | | | 11 | 75 | 100 | 3.5 | 1.8 | 38.1 | 98.3 | 60.2 |
| 29 | | | 15 | 80 | 50 | 3.0 | | 20.9 | 83.2 | 62.3 |
| 30 | | | 15 | 80 | 60 | 3.5 | | 3.3 | 88.3 | 85.0 |
| 31 | | | 15 | 85 | 60 | 0.3 | | 39.0 | 97.3 | 58.3 |
| 32 | | | 15 | 85 | 60 | 2.5 | | 13.0 | 85.7 | 72.7 |

TABLE 4-continued

| | | | | | | | |
|---|---|---|---|---|---|---|---|
| 33 | 12 | 85 | 60 | 2.5 | 37.5 | 97.8 | 60.3 |
| 34 | 12 | 75 | 120 | 2.5 | 14.9 | 86.5 | 71.6 |
| 35 | 15 | 80 | 80 | 1.5 | 26.7 | 98.3 | 71.6 |
| 36 | 15 | 80 | 80 | 3.5 | 2.3 | 77.7 | 75.4 |
| 37 | 15 | 80 | 80 | 3.5 | 7.5 | 83.7 | 76.2 |

| | | | Phosphatability | | | |
|---|---|---|---|---|---|---|
| No. | Average interval of surface pits and bumps Sm (μm) | Max. depth Ry (μm) | Un-precipitated parts of zinc phosphate crystal (%) | Grain size (μm) | P ratio P/P + H | Determination |
| 16 | 17.9 | 18.3 | ◎ | ○ | ○ | ○ |
| 17 | 14.2 | 19.3 | ◎ | ● | ◎ | ◎ |
| 18 | 18.3 | 14.7 | ◎ | ● | ● | ● |
| 19 | 13.7 | 13.9 | ◎ | ◎ | ◎ | ◎ |
| 20 | 15.3 | 15.2 | ◎ | ○ | ○ | ○ |
| 21 | 16.4 | 15.8 | ◎ | ● | ◎ | ◎ |
| 22 | 12.3 | 23.2 | ◎ | ● | ● | ● |
| 23 | 12.7 | 27.4 | ◎ | ◎ | ◎ | ◎ |
| 24 | 22.2 | 9.4 | ◎ | ○ | ○ | ○ |
| 25 | 17.9 | 20.0 | ◎ | ◎ | ◎ | ◎ |
| 26 | 15.3 | 22.2 | ◎ | ● | ● | ● |
| 27 | 26.7 | 12.4 | ○ | ○ | ○ | ○ |
| 28 | 32.1 | 10.0 | X | X | ○ | X |
| 29 | 16.3 | 18.2 | ○ | ○ | ○ | ○ |
| 30 | 13.6 | 15.9 | ◎ | ● | ● | ● |
| 31 | 18.9 | 11.6 | ○ | ○ | ○ | ○ |
| 32 | 14.9 | 19.3 | ◎ | ● | ● | ● |
| 33 | 12.8 | 20.1 | ◎ | ○ | ○ | ○ |
| 34 | 17.3 | 15.3 | ◎ | ◎ | ◎ | ◎ |
| 35 | 19.7 | 16.6 | ○ | ○ | ○ | ○ |
| 36 | 17.7 | 18.3 | X | ○ | X | X |
| 37 | 18.4 | 16.8 | ○ | ○ | ○ | ○ |

The following can be reasoned from Tables 1 to 4.

The specimens Nos. 1, 5, 9, 14 each are a comparative example with a surface condition thereof, deviating from requirements set by the invention, and any of those specimens was found poor in the phosphatability. Further, the specimen No. 13 was obtained by applying a skin pass operation to the specimen No. 11 after the latter was pickled, and because a surface condition of the specimen No. 13 came to deviate from the requirements set by the invention, due to application of the skin pass operation, the phosphatability of thereof were found degraded.

With the specimen No. 16, because a pickling condition was slightly slow, the surface condition meeting the requirements set by the invention was not obtained, so that the phosphatability of thereof remained at an acceptable level.

With the specimen No. 20, because a flow rate of the pickling solution sprayed onto a steel sheet is relatively slow, in addition to a relatively low pickling temperature, and relatively short immersion time, a surface condition thereof was not sufficiently improved, so that the phosphatability of thereof remained at an acceptable level.

With the specimen No. 24, the max. depth (Ry) was found deviating from the requirements set by the invention, due to a skin pass operation applied after pickling, so that the phosphatability of thereof remained at an acceptable level.

The specimen No. 28 represents an example where an average interval (Sm) of pits and bumps, on a surface thereof, was found outside a suitable range set by the invention, and the phosphatability of thereof were found inferior.

With the specimen No. 31, because of an inadequate pickling condition, a suitable surface condition could not be obtained, the phosphatability of thereof remained at an acceptable level.

With the specimen No. 36, a pickling condition was adequate, and a surface condition as well was satisfactory, however, a steel sheet in use contained Mo in an amount exceeding the specified value, so that the phosphatability of thereof were found poor In contrast to those specimens described as above, the specimens Nos. 2 to 4, 6 to 8, 10 to 12, 15, 17 to 19, 21 to 23, 25 to 27, 29, 30, 32 to 35, and 37 each were the working example meeting the requirements set by the invention, and were found obtaining excellent phosphatability.

As for the specimens Nos. 16, 20, 24, and 31, respectively, it is deemed that because steel did not contain M, the phosphatability of thereof were found at the acceptable level although surface conditions deviated from the requirements set by the invention (It is deemed that if the surface conditions should have met the requirements set by the invention, the phosphatability of thereof would have been found at an excellent level or higher).

The invention claimed is:

1. A hot rolled steel sheet characterized in that a maximum depth (Ry) of pits and bumps, existing on a surface thereof, is not less than 10 μm, an average interval (Sm) of the pits and the bumps is not more than 30 μm, and a load length ratio (tp40) of the pits and the bumps on the surface is not more than 20%;

wherein the hot rolled steel sheet contains C ranging from 0.03 to 1.0 mass %, Si not more than 2.0 mass % (including 0 mass %), Mn ranging from 0.3 to 4.0 mass %, Al ranging from 0.001 to 0.5 mass %, Mo not more than 1.0 mass % (including 0 mass %), and Cr not more than 1.5 mass % (including 0 mass %).

2. The hot rolled steel sheet according to claim 1, containing C ranging from 0.5 to 0.23 mass %, Si not more than 1.5 mass % (including 0 mass %), Mn ranging from 0.5 to 2.5 mass %, and Al ranging from 0.005 to 0.3 mass %.

3. The hot rolled steel sheet according to claim 1, containing Mo ranging from 0.05 to 1.0 mass %.

4. The hot rolled steel sheet according to claim 3, wherein tensile strength is not lower than 390 MPa.

5. The hot rolled steel sheet according to claim 4, wherein tensile strength is not lower than 780 MPa.

6. The hot rolled steel sheet according to claim 1, further containing at least one element selected from the group consisting of:

Cr not more than 1.5 mass % (excluding 0 mass %);
Ti not more than 0.2 mass % (excluding 0 mass %);
Nb not more than 0.1 mass % (excluding 0 mass %);
V not more than 0.1 mass % (excluding 0 mass %);
Cu not more than 1.0 mass % (excluding 0 mass %);
Ni not more than 1.0 mass % (excluding 0 mass %);
B not more than 0.002 mass % (excluding 0 mass %); and
Ca not more than 0.005 mass % (excluding 0 mass %).

7. The hot rolled steel sheet according to claim 6, containing Mo ranging from 0.05 to 1.0 mass %.

8. The hot rolled steel sheet according to claim 7, wherein tensile strength is not lower than 390 MPa.

9. The hot rolled steel sheet according to claim 8, wherein tensile strength is not lower than 780 MPa.

10. The hot rolled steel sheet according to claim 1, containing Mo ranging from 0.05 to 1.0 mass %, and Cr ranging from 0.3 to 1.5 mass %, wherein bainite occupies not less than 85 area % of a metal structure, and tensile strength is no lower than 900 MPa.

11. A hot rolled steel sheet characterized in that a maximum depth (Ry) of pits and bumps, existing on a surface thereof, is not less than 10 μm, an average interval (Sm) of the pits and the bumps is not more than 30 μm, and a difference between a load length ratio (tp60) of the pits and the bumps on the surface and a load length ratio (tp40) is not less than 60%;

wherein the hot rolled steel sheet contains C ranging from 0.03 to 1.0 mass %, Si not more than 2.0 mass % (including 0 mass %), Mn ranging from 0.3 to 4.0 mass %, Al ranging from 0.001 to 0.5 mass %, Mo not more than 1.0 mass % (including 0 mass %), and Cr not more than 1.5 mass % (including 0 mass %).

12. The hot rolled steel sheet according to claim 11, containing C ranging from 0.5 to 0.23 mass %, Si not more than 1.5 mass % (including 0mass %), Mn ranging from 0.5 to 2.5 mass %, and Al ranging from 0.005 to 0.3 mass %.

13. The hot rolled steel sheet according to claim 11, containing Mo ranging from 0.05 to 1.0 mass %.

14. The hot rolled steel sheet according to claim 11, containing Mo ranging from 0.05 to 1.0 mass %, and Cr ranging from 0.3 to 1.5 mass %, wherein bainite occupies not less than 85 area % of a metal structure, and tensile strength is no lower than 900 MPa.

15. The hot rolled steel sheet according to claim 11, further containing at least one element selected from the group consisting of:

Cr not more than 1.5 mass % (excluding 0 mass %);
Ti not more than 0.2 mass % (excluding 0 mass %);
Nb not more than 0.1 mass % (excluding 0 mass %);
V not more than 0.1 mass % (excluding 0 mass %);
Cu not more than 1.0 mass % (excluding 0 mass %);
Ni not more than 1.0 mass % (excluding 0 mass %);
B not more than 0.002 mass % (excluding 0 mass %); and
Ca not more than 0.005 mass % (excluding 0 mass %).

16. A hot rolled steel sheet characterized in that a maximum depth (Ry) of pits and bumps, existing on a surface thereof, is not less than 10 μm, an average interval (Sm) of the pits and the bumps is not more than 30 μm, a load length ratio (tp40) of the pits and the bumps on the surface is not more than 20%, and a difference between a load length ratio (tp60) of the pits and the bumps on the surface and the load length ratio (tp40) is not less than 60%;

wherein the hot rolled steel sheet contains C ranging from 0.03 to 1.0 mass %, Si not more than 2.0 mass % (including 0 mass %), Mn ranging from 0.3 to 4.0mass %, Al ranging from 0.001 to 0.5 mass %, Mo not more than 1.0 mass % (including 0 mass %), and Cr not more than 1.5 mass % (including 0 mass %).

17. The hot rolled steel sheet according to claim 16, containing C ranging from 0.5 to 0.23 mass %, Si not more than 1.5 mass % (including 0mass %), Mn ranging from 0.5 to 2.5 mass %, and Al ranging from 0.005 to 0.3 mass %.

18. The hot rolled steel sheet according to claim 16, containing Mo ranging from 0.05 to 1.0 mass %.

19. The hot rolled steel sheet according to claim 16, containing Mo ranging from 0.05 to 1.0 mass %, and Cr ranging from 0.3 to 1.5 mass %, wherein bainite occupies not less than 85 area % of a metal structure, and tensile strength is no lower than 900 MPa.

20. The hot rolled steel sheet according to claim 16, further containing at least one element selected from the group consisting of:

Cr not more than 1.5 mass % (excluding 0 mass %);
Ti not more than 0.2 mass % (excluding 0 mass %);
Nb not more than 0.1 mass % (excluding 0 mass %);
V not more than 0.1 mass % (excluding 0 mass %);
Cu not more than 1.0 mass % (excluding 0 mass %);
Ni not more than 1.0 mass % (excluding 0 mass %);
B not more than 0.002 mass % (excluding 0 mass %); and
Ca not more than 0.005 mass % (excluding 0 mass %).

* * * * *